United States Patent [19]

Cook

[11] Patent Number: 4,801,098

[45] Date of Patent: Jan. 31, 1989

[54] PULVERIZING APPARATUS

[76] Inventor: Graeme E. Cook, 851 Lytton Road, Queensport, Queensland 4152, Australia

[21] Appl. No.: 95,540

[22] PCT Filed: Nov. 7, 1986

[86] PCT No.: PCT/AU86/00344

§ 371 Date: Jul. 6, 1987

§ 102(e) Date: Jul. 6, 1987

[87] PCT Pub. No.: WO87/02912

PCT Pub. Date: May 21, 1987

[30] Foreign Application Priority Data

Nov. 7, 1985 [AU] Australia ..... PH3292

[51] Int. Cl.[4] ..... B02C 7/06

[52] U.S. Cl. ..... 241/37; 241/166; 241/261.2

[58] Field of Search ..... 241/100, 261.2, 261.3, 241/166, 37, 259.1, 259.2, 57, 259.3, 36, 30, 18, 99, 33, 34

[56] References Cited

U.S. PATENT DOCUMENTS 3,219,282 11/1965 Horstman ..... 241/166 X
3,302,893 2/1967 Feder et al. ..... 241/259.2 X
4,052,012 10/1977 Feist ..... 241/100
4,275,851 6/1981 Weese ..... 241/99 X

FOREIGN PATENT DOCUMENTS 795563 1/1981 U.S.S.R. ..... 241/100

*Primary Examiner*—Mark Rosenbaum
*Attorney, Agent, or Firm*—Armstrong, Nikaido, Marmelstein & Kubovcik

[57] ABSTRACT

A pulverizing mill for reducing mineral samples includes a cowl arranged about pulverizing anvils and respective sample and air inlets pass through the cowl to the anvils. The cowl forms a confinement about the anvils so that during pulverizing operations the pulverized samples is directed thereby to a suitable receiver. During subsequent clean operations the cowl encloses the anvils so that an air blast may be introduced thrugh the air inlet to scour the anvils and clean the interior of the cowl.

32 Claims, 5 Drawing Sheets

PULVERIZING APPARATUS

FIELD OF THE INVENTION

This invention relates to methods of and apparatus for pulverizing materials. It is particularly but not exclusively suited to reducing mineral samples.

BACKGROUND OF THE INVENTION

Geological or mineral samples have to be reduced to a fine powder for assaying purposes and normally this is carried out in a sample pulverizing machine. Conventional sample pulverizing machines comprise a pair of anvils one of which is rotatable about a horizontal axis and the other being mounted for pivotal movement between co-operating and remote positions with respect to the rotating anvil to permit pulverizing of sample and subsequent access for manual cleaning of the anvils.

Sample grinding times are relatively short, for example up to about thirty seconds. However the subsequent cleaning of the apparatus which is necessary to prevent cross-contamination of samples takes considerable time and thus the full grinding and cleaning cycle averages about three minutes per sample. This is partly due to the configuration of the anvil cavity but mainly it is due to the need to physically open up the apparatus to provide access to the anvils for cleaning.

Many geological samples are very abrasive. Thus the anvils wear quickly and regular adjustment is necessary to compensate for this wear. This can lead to variations in sample particle size if the necessary adjustments are not detected and made. Of course this is undesirable and considerable time is spent checking the wear on conventional pulverizers.

SUMMARY OF THE INVENTION

This invention aims to alleviate the abovementioned disadvantages associated with the presently available apparatus and to provide methods of apparatus for pulverizing samples which will be reliable and efficient in use. Other objects and advantages of this invention will hereinafter become apparent.

With the foregoing and other objects in view, this invention in one aspect resides broadly in a mill assembly for reducing sample particles to a desired particle size. The mill assembly includes a pulverizing mill having a mill chamber into which sample may be introduced for reduction to the desired particle size. An enclosure assembly confines reduced sample discharged from the pulverizing mill for collection in a sample collection device. A cleaning fluid supply device associated with the pulverizing mill introduces cleaning fluid to the mill chamber and the enclosure assembly. A mill release device permits large particles remaining in the pulverizing mill to be discharged with the cleaning fluid.

Suitably the pulverizing device and the fluid supply device are oerated automatically and there are provided sensing devices associated with selected components of the mill assembly whereby selected functions can be monitored in order to satisfy preselected conditions before respective stages of operation of the mill assembly are commenced. The cleaning fluid supply device may supply an air blast to the anvil faces for cleansing the latter or it may supply a suspension of particulate material in air, such as snd, sawdust or pearlite. It may also be a suitable liquid if necessary. An alarm device may be provided to indicate a malfunction. Manual override controls may also provided so that the mill may be manually operated if desired.

Preferably the pulverizing device is a rotary pulverizing mill having a pair of co-operating disc-like anvils at least one of which is rotatable. The anvils are adapted to be supported in a face to face abutting relationship so as to define substantially abutting peripheral portions between which the pulverized substance may pass and an inner mill chamber into which the substance may be introduced. However a cone type mill or an orbital anvil mill may be used if desired. The pulverizing device is preferably adapted to pulverize mineral samples for assaying and for this purpose the reduced particle size may be in the range 50 to 200 microns and suitably in the rage 100–150 microns. It is also preferred that the rotary pulverizing mill is so formed that after pulverizing operations have been completed, the anvils may be separated or released a predetermined amount prior to cleaning fluid being introduced into the mill chamber whereby a free exit passage for a remaining sample is formed between the spaced anvils. It is also preferred that during cleaning operations the or each rotatable anvil is rotated in respective opposite directions for a preselected number of turns to provide enhanced cleaning by the cleaning fluid.

Preferably the rotatable anvil is held against axial movement and the other anvil is restrained against rotation and supported for reciprocal movement towards and away from the rotatable anvil. The reciprocable anvil may be provided with a locking device for maintaining it in its desired axial position relative to the rotatable anvil during pulverizing operations.

It is also preferred that the enclosure assembly be in the form of a cowl assembly which extends about the anvils to enclosre the milled discharge so as to collect the milled material. Suitably the cowl is provided with an access opening through which access to the anvils may be gained for inspection or manual cleaning. Preferably the cowl extends about the non-rotary and rotary anvils so as to enclose the junction between the anvils whereby a sample discharged therefrom may be conveyed through an outlet chut to a collection tray is provided for collection of the sample discharged into the cowl. Of course if desired the sample could be collected in the cowl and be collected therefrom. It is also preferred that the cowl be able to be withdrawn from both anvils to enable visual inspection of the grinding faces of both anvils and the interior of the cowl to be performed. If desired of course both or either anvil could be mounted reciprocally or pivotally or otherwise movable to enable them to be moved relative to one another and the cowl to desired positions.

Another aspect this invention resides in a discharge cowl for receiving the pulverized material from a rotary pulverizing mill. The cowl includes a pair of cowl parts adapted to be brought together about engaged rotary anvils of the pulverizing mill to enclose the latter having collection and discharge devices for directing pulverized material to a receiving station.

In a further aspect this invention resides broadly in a method of reducing respective samples in a mill assembly to samples having a selected particle size. The method includes introducing a sample to the mill assembly; actuating the mill assembly to reduce the sample to the desired particle size; collecting and removing the pulverized sample; introducing cleaning fluid to the mill assembly to remove the remaining sample and repeating the above step.

BRIEF DESCRIPTION OF THE DRAWINGS

In order that this invention may be more readily understood and put into practical effect, reference will be made to the accompanying drawings which illustrate a preferred embodiment of the invention, and wherein.

DESCRIPTION OF THE PREFERRED EMBODIMENTS

Figure 1:
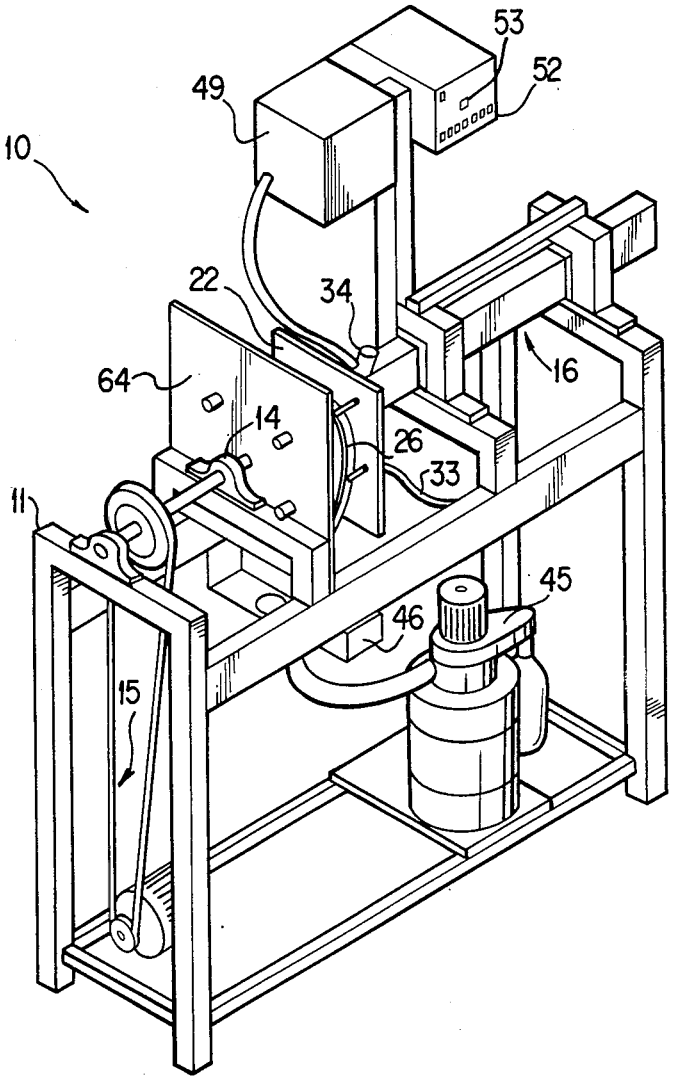
FIG. 1 is an overall view of a preferred form of a pulverizing mill made according to the present invention.
Figure 2:
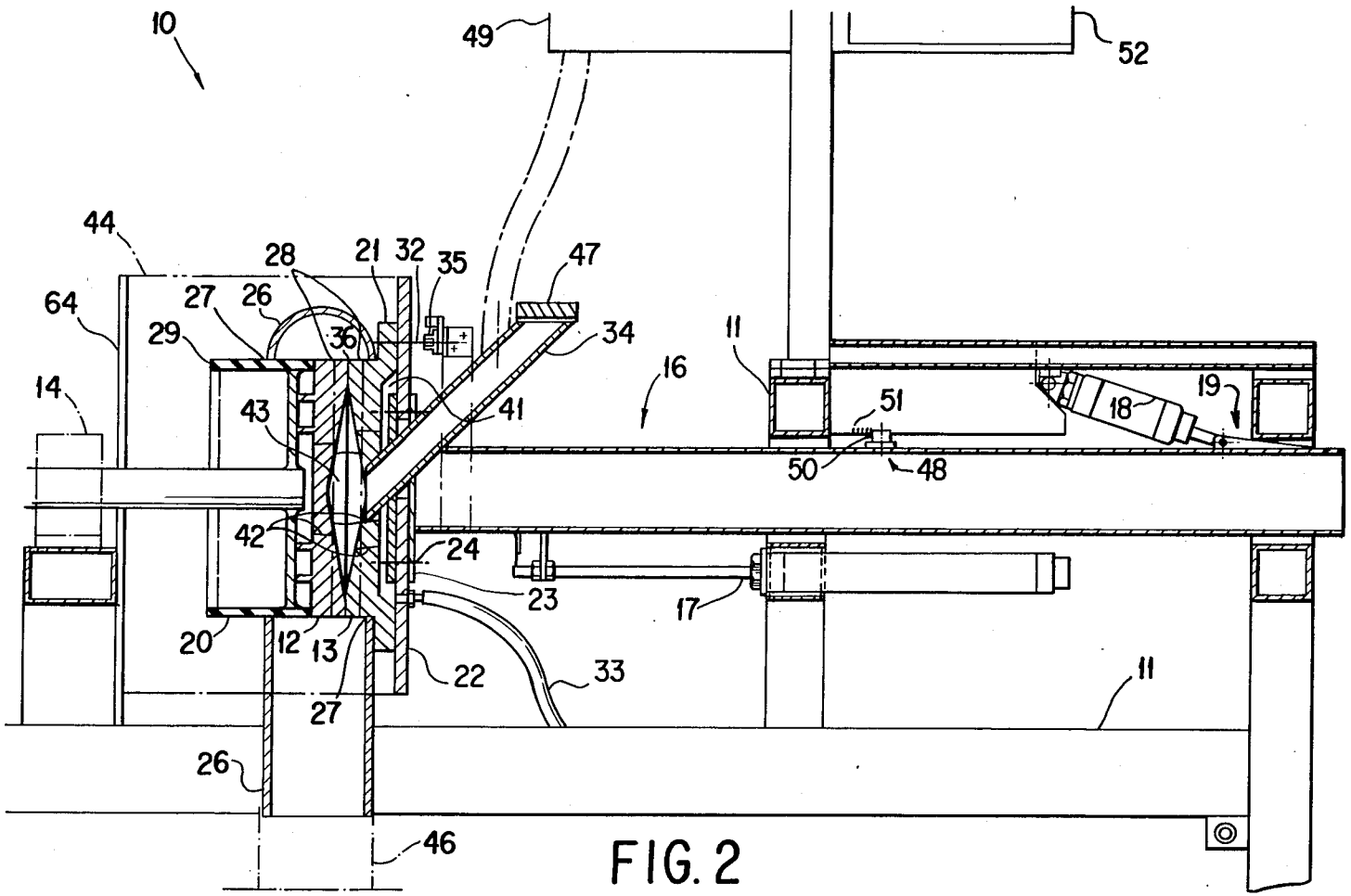
FIG. 2 is a cutaway side view of the mill.

Referring to FIG. 1 and FIG. 2 it will be seen that the mill assembly 10 comprises a bed 11 on which is supported a rotary disc-like anvil 12 driven by a belt drive assembly 15 and restrained from axial movement by a thrust bearing 14. The bed 11 also supports a non-rotary disc like anvil 13 which is mounted on a reciprocal tailstock assembly 16 actuated by a push-pull pneumatic ram 17 operable to selectively position the non-rotary anvil 13 relative to the rotary anvil 12. A further pneumatic ram 18 actuates a wedge type lock assembly 19. This lock assembly 19 is actuated to hold the non-rotary anvil 13 adjacent the rotating anvil 12 during pulverizing operations.

The rotary anvil 12 is secured fixedly by suitable fastening means to a drum like mounting assembly 20 while the non-rotary anvil 13 is provided with an outer mounting flange 21 which is apertured for through bolting to a backing plate 22 which is bolted to a mounting plate 23 fixed to the tailstock assembly 16. The mounting bolts 24, which connect the backing plate, 22 to the mounting plate pass into arcuate slots 25 whereby the bolts 24 may be tightened to a predetermined torque such that the non-rotary anvil may slip to a limited extent relative to the mounting plate 23 should the anvils 12 and 13 become locked together in use.

A tear-drop shaped cowl 26, provided with spaced circular openings 27, fits neatly about the outer cylindrical surfaces 28 of the anvil 13 and the mounting drum 20. The length of the mounting drum 20 is of such width that the cowl 26 may be slid to a position overlying the end of the drum 20 distant from the anvils and remote from the anvils 12 and 13 so that they may be exposed for cleaning or inspection. A stop flange 29 is provided to limit movement of the cowl 26 along this drum 20.

Figure 3:
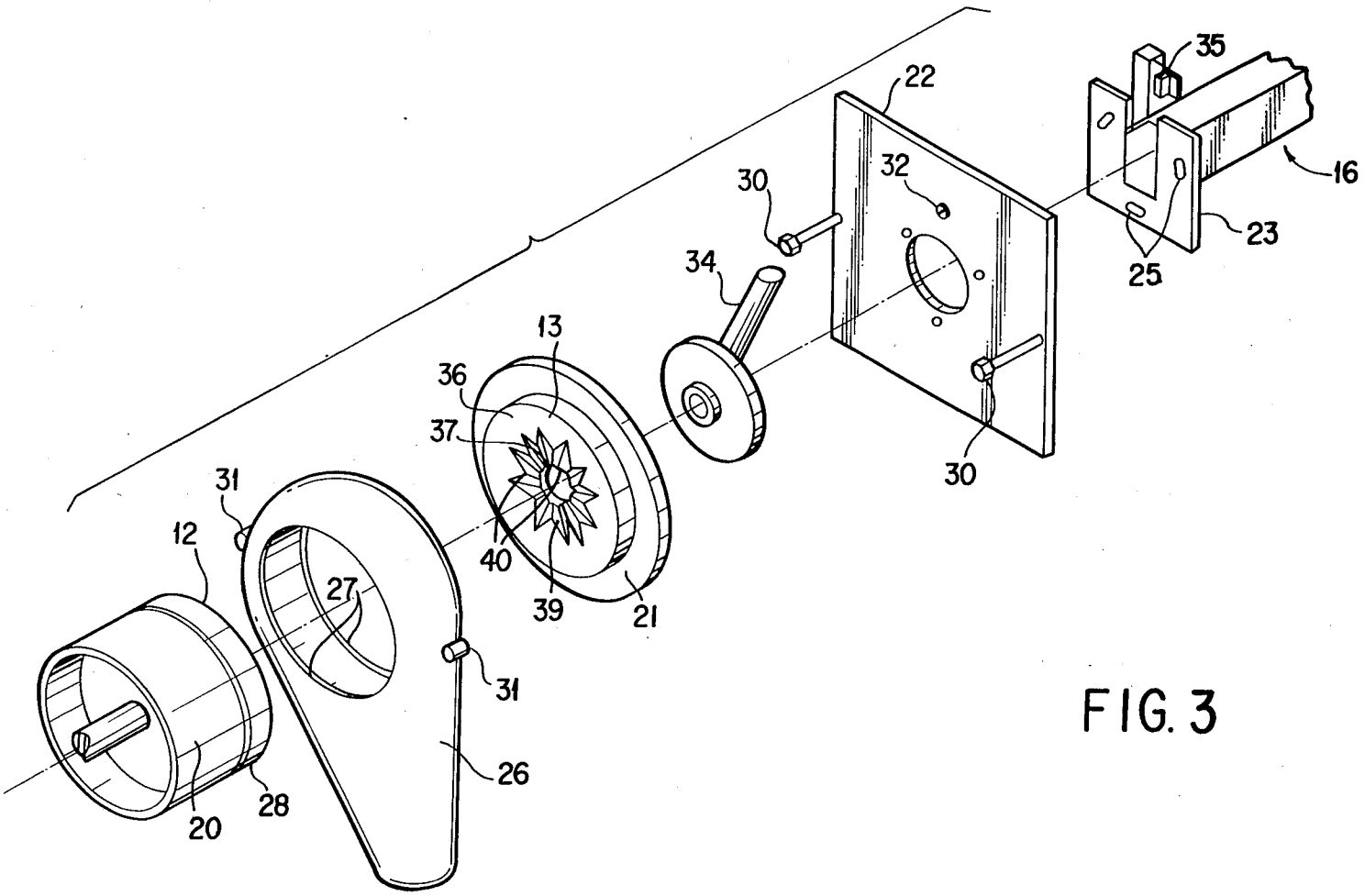
FIG. 3 is an exploded perspective view of the anvils and associated components.

As shown in FIG. 3, the backing plate 22 also supports a pair of spigots 30 which engage in corresponding sockets 31 provided on the cowl 26 to operatively locate the cowl 26 about the anvils 12 and 13. Thus should the cowl 26 rotate by accidental engagement with the rotary anvil 12 it will also cause the mounting bolts 24 to move along the arcuate slots.

A reciprocable plunger 32 is supported slidably in openings in the backing plate 22 and the flange 21 and it is spring biased towards the rotary anvil 12. This plunger 32 is contracted by the cowl 26 and retracted upon movement of the cowl 26 to its operative position at which the cowl is located by the spigots 30 adjacent the backing plate 22. The plunger 32 when depressed shields an opto sensor 35 mounted on the tailstock so that during normal operations the opto sensor will signal an operative mode. If the cowl 26 is not operatively positioned, the plunger 32 will not shield the opto sensor 35 and an inoperative mode will be signalled. Furthermore if the anvils 12 and 13 should become locked together or the cowl 26 be displaced by the rotary anvil 12, the rotation of the non-rotary anvil 13 relative to the mounting plate 23 will carry the plunger 32 away from the opto sensor 35 which will then signal an inoperative mode.

Figure 4:
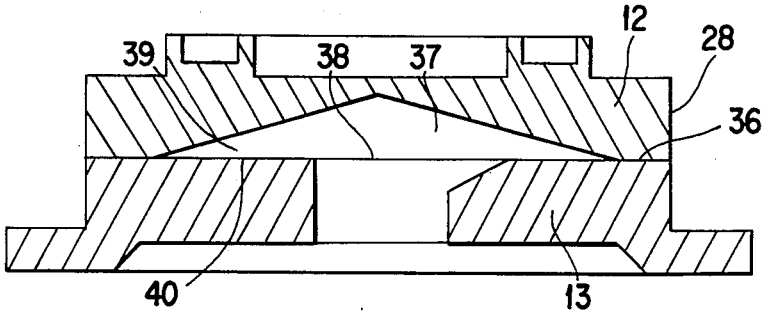
FIG. 4 is a cross-sectional view of the mill anvils disposed with their corresponding recesses out of phase.

As shown in FIGS. 3 and 4, each anvil 12 and 13 is of disc-like form having a cylindrical outer peripheral portion 36 and an inner star-like recess 37 having a deep central cavity 38 and spear like recesses 39 radiating therefrom. These recesses 39 reduce in depth towards the outer peripheral portion 36 as illustrated. The recess 37 is partially divided into three segments by the radial dividing walls 40 having top or outer grinding faces co-planar with the outer peripheral portion 36.

The mill assembly 10 is provided with an inlet chute 34 to the central cavity 38 through which sample to be milled passes into the central cavity 38 of the anvils. A plenum chamber 41 is formed about the chute 34 and between the anvil 13 and backing plate 22 and air inlet passages 42 extend from the chamber 41 into the mill chamber 43 formed between the two recesses 37. Air is supplied thereto as required for cleaning purposes from air supply apparatus 33. Further air inlets may be provided through the feed chute and through the anvils if desired. A further plenum chamber may be provided in the rotary anvil 12 for feeding air into the chamber 43 if desired.

An outer housing, shown in dotted outline at 44, encloses the pulverizing mill and cowl 26. This enclosure 44 is adapted to be evacuated by the suction pump 45 so that in use during pulverizing operations and during subsequent cleaning operations when the sample tray 46 is removed, dust and other waste material collected in the enclosure 44 is removed in a suitable filter associated with the suction pump 45.

In use, for example, a geological sample is introduced into the feed chute 34 and the lid 47 is then closed. The rotary anvil 12 is rotated until the sample has been pulverized to the desired particle size. This pulverized sample flows outwardly between the mating faces 36 of the anvils 12 and 13 into the cowl 26 for discharge into the tray 46. After the sample has been pulverized the cleaning mode is actuated either automatically upon removal of the sample tray 46, or manually if a cleaning mode button is pressed.

Upon commencement of the cleaning cycle, the lock assembly 19 is released and the non-rotary anvil 13 is retracted a set amount as preset by the tailstock location sensor assembly 48 to enable material remaining between the anvils and within the cowl to be flushed out by air blast, or other means, introduced at a suitable pressure from the plenum chamber 41. This air blast, with assistance from the evacuated enclosure 44, will remove substantially all foreign material from the anvils 12 and 13 and the cowl 26. During the cleaning cycle, the rotary anvil 12 may be rotated intermittently in opposite directions. This is controlled by a selector switch on a control panel which indicates the number of reversals of rotation of the anvil required. Rotation of the anvil 12 will assist removal of residue by centrifugal force as the residue can move freely outwards along the spear like recesses 39. A counter is provided for monitoring this reversal of rotation.

Upon completion of this cycle, the non-rotary anvil 13 is further retracted from the cowl 26 to enable visual inspection and further manual cleaning if necessary. Furthermore if required sand from the hopper 49 may be introduced after the grind phase and before the air blast cleaning phase to scour the anvil faces. The sand is introduced through the feed chute 34.

When cleaning is complete, the ram 17 may be actuated to move the anvil 13 back into abutting relationship with the anvil 12 at a predetermined bearing pressure. If the anvils have worn, the tail stock location sensor assembly 48 will automatically reset so that when commanded it will control the tailstock for the desired amount of initial retraction irrespective of the state of wear of the anvils 12 and 13. Suitably the sensor assembly 48 is a counter which includes a light sensitive device 50 mounted on the tailstock 16 and co-operating with an interrupter plate 51 fixed to the bed 11 whereby retraction can be set for movement of the sensor 50 past a selected number of segments of the interruptor plate 51. Thus the amount of retraction will be unaffected by the initial starting point of the sensor 50 which will vary with anvil wear.

Figure 5:
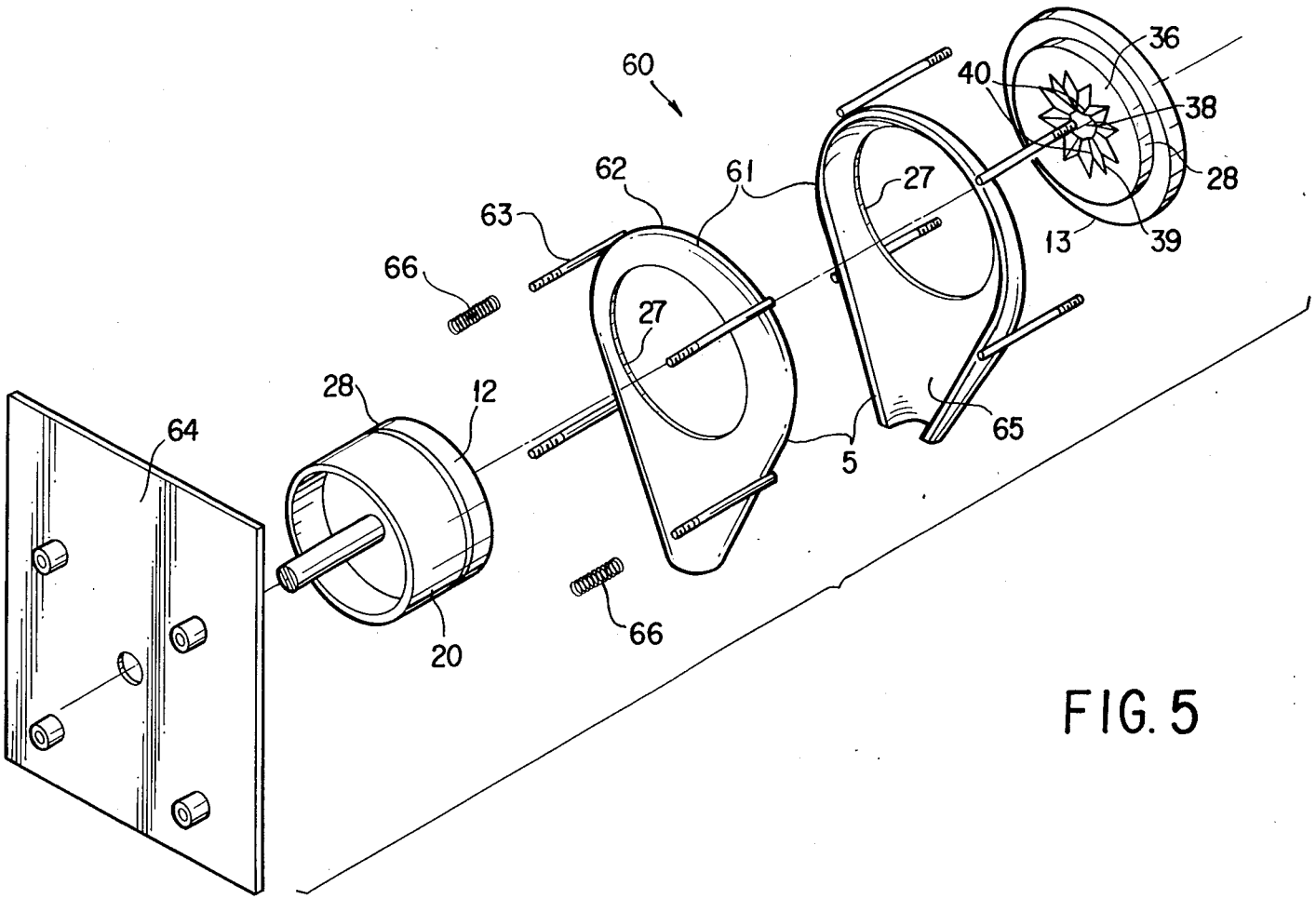
FIG. 5 illustrates an alternate form of the cowl assembly.

An alternate form of cowl assembly 60 is shown in FIG. 5, it will be seen that the cowl 61 is split along the transverse vertical center line enabling one part 62 of the cowl to be adjustably mounted by bolts 63 to the headstock assembly 64 and the other part 65 of the cowl to be mounted on the reciprocating tailstock assembly 16. Part 65 may be retracted against the springs 66 which bias the movable part 62 to an engaged position at which it abuts the other part 65 to form the complete cowl 61. When so retracted the anvils are exposed to facilitate final cleaning and inspection. One part of the cowl 61 may be provided with a locating rim which, when the tailstock is advanced to the "grind" position, engages the other half to form an effective enclosure about the anvils 12 and 13. The abutting faces 5 of the cowl parts 62 and 64 are maintained in contact, regardless of anvil wear, by one or both cowl sections being spring biassed as shown.

Figure 6:
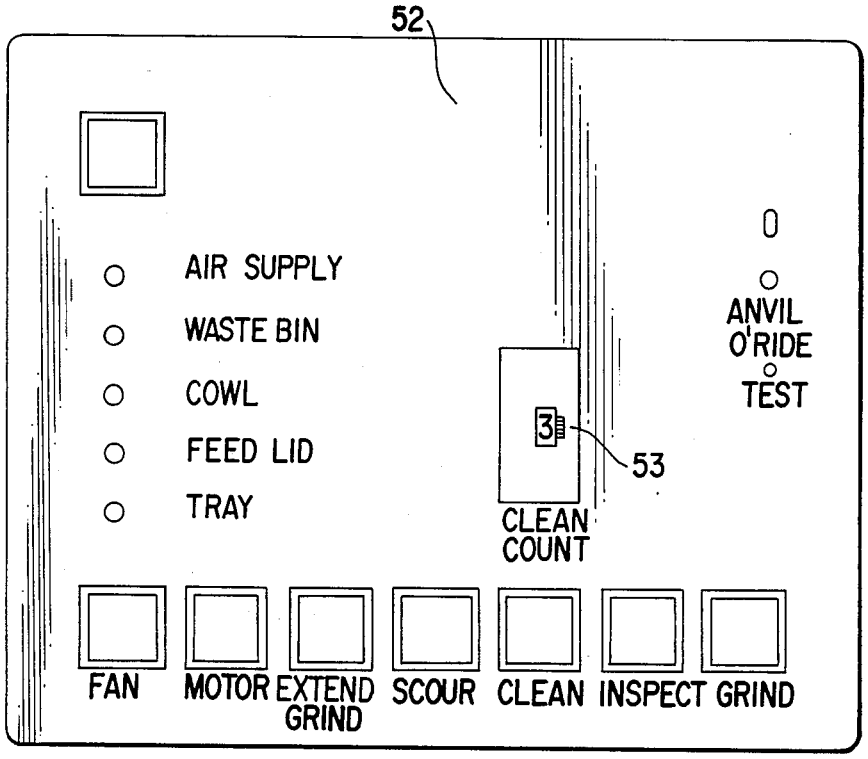
FIG. 6 illustrates a typical control panel layout.

The above described embodiments facilitates automatic control whereby manual cleaning is substantially eliminated. In this respect the mill assembly 10 is controlled by suitable programmable electronic control apparatus, not illustrated, actuated through a control panel 52 illustrated in FIG. 6. The control panel 52 includes indicators for various parts of the apparatus which co-operate with corresponding sensors (not shown) on the mill 10 and its ancilliary equipment which must be checked before any new action is commenced or which sense a malfunction, such as the opto sensor 35. For example the mill is automatically controlled so that air will not be supplied to the mill chamber 43 from the plenum chamber 41 until the sensing means indicates that the feed chute lid 47 has been closed, the sample tray 46 removed and unless the cowl 26 is in position. Air blast cleaning will continue for the number of anvil reversals dialled by the operator by the selector switch 53 on the control panel 52.

Suitably the logic diagram may include the necessary safety checks and interlocks for efficient operation and safety of the operator. For example it may include checks to ensure that the automatic cleaning cycle will not commence until at least the sensing means indicate that the sample tray has been removed and the anvils have been separated a predetermined amount. Also, the checks ensure that the grinding phase will not commence until the sample tray is located and the cowl is in its operative position. Furthermore the optional scouring phase will not commence if the sample tray is positioned. Time delays are also utilized to allow adequate time for mechanical operations to be performed.

It will of course be realised that the above has been given only by way of illustrative example of the invention and that all such modifications and variations as would be apparent to persons skilled in the art are deemed to fall within the broad scope and ambit of the invention as is defined in the appended claims. The claims defining the invention are as follows.

I claim:

1. A mill assembly for reducing crude or semiprocessed mineral sample particles to a representative mineral sample of desired particulate size, said mill assembly being a rotary pulverizing mill comprising:

a pair of opposed disc-like recessed anvils which are relatively rotatably about a mill axis and arranged in a face to face abutting relationship, recesses in said anvils cooperation to define a mill chamber having a peripheral discharge opening about said mill chamber and extending between adjacent peripheral edges of said anvils and through which reduced desired size particles may be discharged;

one of said anvil being rotatable about said mill axis and having a cylindrical peripheral edge portion co-axial with said axis and the other said anvil being fixed against rotation and being provided with a sample inlet through which a sample may be introduced to said mill chamber;

mill release means for axially separating said anvils sufficiently to permit visual inspection of said recesses for particles remaining in said mill chamber;

an enclosure assembly about said peripheral discharge opening for confining reduced sample discharged from the pulverizing mill;

an outlet from said enclosure assembly for discharge of the sample in said collection means;

said enclosure assembly including a first wall assembly mounted on and extending outwardly from the peripheral edge of said other anvil and a complementary wall assembly which engages with said first wall assembly to form said enclosure assembly, said complementary wall assembly having a mounting aperture which fits closely about said cylindrical peripheral edge portion, said wall assemblies being mounted for relative axial movement with respect to one another and said mill assembly; and biasing means for moving said wall assemblies into abutting relationship during actuation of said mill assembly.

2. A mill assembly according to claim 1, wherein said other anvil is supported for reciprocal movement to and from said one anvil and said mill release means is operable to reciprocate said other anvil.

3. A mill assembly according to claim 2, wherein said one anvil and said complementary wall assembly are supported on a headstock assembly and said other anvil and said first wall assembly are supported by a tailstock assembly for reciprocation to and from said one anvil.

4. A mill assembly according to claim 3, wherein said tailstock assembly is to force said anvils together at a predetermined bearing pressure and releasable locking means is provided to hold said anvils together at said predetermined bearing pressure.

5. A mill assembly according to claim 1, wherein said complementary wall assembly is supported reciprocally on said headstock assembly for independent movement towards or away from said first wall.

6. A mill assembly according to claim 5, wherein said first and complementary wall assemblies are selectively moveable between a confining attitude about said anvils and an inspection attitude at which said anvils are exposed.

7. A mill assembly according to claim 6, wherein said anvils have central sample receiving recesses and a plurality of tapering recesses radiating therefrom to a position inwardly of said peripheral discharge opening.

8. A mill assembly according to claim 7, wherein the face to face anvil faces are each contained in a plane at right angles to said mill axis.

9. A mill assembly according to claim 7, wherein said tapering recesses are separated by co-planar radial walls.

10. A mill assembly according to claim 1, wherein there is provided cleaning fluid supply means associated with said pulverizing mill for introducing cleaning fluid to said mill chamber.

11. A mill assembly according to claim 10, wherein said cleaning fluid supply means includes an inlet means extending through said anvils to said mill chamber.

12. A mill assembly according to claim 10, wherein said inlet means comprise a plurality of air inlets through said other anvil to said mill chamber and plenum chamber through which air may be supplied to said air inlets.

13. A mill assembly according to claim 1, and including sensing means for sensing positions of the mill components and control means for automatically actuating said mill in a predetermined sequence and said control means being to actuate each mill operation after checking said sensing means for completion of each step.

14. A mill assembly for reducing crude or semiprocessed mineral sample particles to a representative mineral sample of desired particulate size, said mill assembly being a rotary pulverizing mill comprising:

a pair of opposed disc-like recessed anvils which are relatively rotatable about a mill axis and arranged in a face to face substantially abutting relationship, recesses in said anvils cooperate to define a mill chamber having a peripheral discharge opening about said mill chamber and extending between adjacent peripheral edges of said anvils and through which reduced desired size particles may be discharged, one said anvil being supported rotatably about a mill axis on a headstock assembly and having a cylindrical peripheral edge portion coaxial with said axis and the other said anvil being fixed against rotation and supported for reciprocal movement to and from said one anvil on a tailstock assembly and provided with a sample inlet through which a sample may be introduced to said mill chamber;

mill release means operable to reciprocate said other anvil;

an enclosure assembly about said peripheral discharge opening for confining reduced sample discharge from the pulverizing mill;

an outlet from said enclosure assembly for discharge of the sample in said collection means;

said enclosure assembly including a first wall assembly mounted on and extending outwardly from the peripheral edge of said other anvil and a complementary wall assembly which engages with said first wall assembly to form said enclosure;

said complementary wall assembly being supported reciprocally on said headstock assembly for independent movement towards or away from said first wall assembly and having a mounting aperture which fits closely about said cylindrical peripheral edge portion;

said wall assemblies being mounted for relative axial movement with respect to one another and said mill assembly; and biasing means for moving said wall assemblies into abutting relationship during actuation of said mill assembly.

15. A mill assembly according to claim 14, wherein said tailstock assembly is to force said anvils together at a predetermined bearing pressure and releasable locking means is provided to hold said anvils together at said predetermined bearing pressure.

16. A mill assembly according to claim 15, wherein said first and complementary wall assemblies are selectively moveable between a confining attitude about said anvils and an inspection attitude at which said anvils are exposed.

17. A mill assembly according to claim 14, wherein said anvils have central sample receiving recesses and a plurality of tapering recesses radiating therefrom to a position inwardly of said peripheral discharge opening.

18. A mill assembly according to claim 14, further including a sensing means for sensing positions of mill components and a control means for automatically actuating said mill in a predetermined sequence, said control means to actuate each mill operation after checking said sensing means for completion of each operational step of actuation of said mill assembly.

19. A mill assembly for reducing crude or semiprocessed mineral sample particles to a representative mineral sample of desired particulate size, said mill assembling being a rotary pulverizing mill comprising:

a pair of opposed disc-like recessed anvils which are relatively rotatable about a mill axis and arranged in a face to face substantially abutting relationship, recesses in said anvils cooperate to define a mill chamber having a peripheral discharge opening about said mill chamber and extending between adjacent peripheral edges of said anvils and through which reduced desired size particles may be discharged, one said anvil being supported rotatably about a mill axis on a headstock assembly and having a cylindrical peripheral edge portion coaxial with said axis and the other said anvil being fixed against rotation and supported for reciprocal movement to and from said one anvil on a tailstock assembly and provided with a sample inlet through which a sample may be introduced to said mill chamber;

mill release means operable to reciprocate said other anvil;

an enclosure assembly about said peripheral discharge opening for confining reduced sample discharged from the pulverizing mill;

an outlet from said enclosure assembly for discharge of sample in said collection means;

said enclosure assembly including a first wall assembly mounted on and extending outwardly from the peripheral edge of said other anvil and complementary wall assembly which engages with said first wall assembly to form said enclosure, said complementary wall assembly being supported reciprocally on said headstock assembly for independent movement towards or away from said first wall assembly and having a mounting aperture which fits closely about said cylindrical peripheral edge portion;

said wall assemblies being mounted for relative axial movement with respect to one another and said mill assembly;

biasing means for moving said wall assemblies into abutting relationship during actuation of said mill assembly;

cleaning fluid supply means associated with said pulverizing mill for introducing cleaning fluid to said mill chamber;

sensing means for sensing positions of the mill components;

a control means for automatically actuating said mill in a predetermined sequence; and said control means to actuate each mill operation after checking said sensing means for completion of each operational step of actuation.

20. A mill assembly for reducing sample particles to a desired particle size, said mill assembly comprising:

a pulverizing mill including first and second disc-like anvils arranged in a face to face abutting relationship to define therebetween a mill chamber, said first anvil being supported rotatably about a mill axis, said second anvil being fixed against rotation and being reciprocally movable to and from said first anvil;

an enclosure assembly for confining reduced sample discharged from said pulverizing mill for collection, said enclosure assembly being movable between a position surrounding said pair of anvils and a position at which said anvils are exposed from said enclosure assembly;

cleaning fluid supply means for introducing cleaning fluid to said mill chamber and said enclosure assembly; and mill release means for permitting large particles remaining in said pulverizing mill to be discharged with said cleaning fluid.

21. A mill assembly to claim 20, wherein said enclosure assembly is a cowl having a pair of opposed mounting apertures which fit closely about outer cylindrical portions of each said anvil.

22. A mill assembly according to claim 21, wherein said cowl is a split cowl which is split intermediate said mounting apertures and wherein one part of said split cowl is mounted on a fixed supporting structure which supports said one anvil and the other part of said split cowl is mounted on movable supporting structure which supports said other anvil.

23. A mill assembly according to any one of claim 21 to 22, wherein said cowl has a lower chute through which pulverized material is conveyed to a removable sample collection tray.

24. A mill assembly according to claim 22, wherein said fixed supporting structure is in the form of a headstock assembly which supports said one anvil for rotation about its axis and said movable supporting structure is in the form of a tailstock assembly which supports said other anvil for reciprocation to and from said one anvil and wherein said tailstock assembly constitutes said release means.

25. A mill assembly according to claim 24, wherein said tailstock assembly is to force said anvils together at a predetermined bearing pressure and releasable locking means are provided to hold said anvils together at said predetermined bearing pressure.

26. A mill assembly according to any one of claims 20, 21, 22, 24 or 25 wherein said anvils each have central sample receiving recesses and a plurality of recesses radiating therefrom to a position inwardly of said peripheral discharge zone and wherein the axial depth of said recesses reduces progressively towards said peripheral discharge zone.

27. A mill assembly according to claim 26, wherein said recesses are spear-like and said faces which define said peripheral discharge zone therebetween are each contained in a plane at right angles to the axis of rotation of said anvils.

28. A mill assembly according to claim 27, wherein said tapering recesses are separated by radial walls coplanar with and extending inwardly from said peripheral faces.

29. A mill assembly according to claim 20, wherein said cleaning fluid supply means includes air inlet means extending through said anvils to the mill chamber.

30. A mill assembly according to claim 29, wherein said air inlet means comprise a plurality of air inlets extending through said fixed anvil to said mill chamber and a plenum chamber through which air may be supplied to said air inlets.

31. A mill assembly as defined in claim 20 and including sensing means for sensing positions of the mill components and control means for automatically actuating said mill in a predetermined sequence and said control means being to actuate each mill operation after checking said sensing means for completion of each step.

32. A mill assembly according to claim 20 wherein said pulverizing mill is to pulverize mineral samples to a particle size in the range of 50 to 200 microns.

* * * * *